United States Patent [19]

White et al.

[11] Patent Number: 4,961,019

[45] Date of Patent: Oct. 2, 1990

[54] METAL HALIDE LAMP ASSEMBLY

[75] Inventors: Robert S. White, Beverly; Elliot F. Wyner, West Peabody; John A. Scholz, Danvers, all of Mass.

[73] Assignee: GTE Products Corporation, Danvers, Mass.

[21] Appl. No.: 257,606

[22] Filed: Oct. 14, 1988

[51] Int. Cl.[5] ..... H01J 17/02; H01J 61/34

[52] U.S. Cl. ..... 313/25; 313/634; 313/113

[58] Field of Search ..... 313/25, 634, 113

[56] References Cited

U.S. PATENT DOCUMENTS 2,879,449 3/1959 Macksoud ..... 313/113 X 4,499,396 2/1985 Fohl et al. ..... 313/634 X

*Primary Examiner*—Sandra O'Shea

*Attorney, Agent, or Firm*—Wolf, Greenfield & Sacks

[57] ABSTRACT

An electric lamp includes a lamp assembly mounted in a lamp envelope including a reflector, a lens and a base for connection to an electrical source. The lamp assembly includes an arc tube having a longitudinal axis aligned with the optical axis of the reflector, an arc tube support strap attached to one end of the arc tube and including legs extending laterally in opposite directions from the axis of the arc tube, bulb spacers coupled to the legs of the support strap for positioning the arc tube relative to the lamp envelope, a light-transmissive shroud around the arc tube, and electrode supports coupled to the upper and lower electrode leads of the arc tube. The shroud includes an open end which abuts against the legs of the support strap and a domed end which substantially encloses one end of the arc tube. The electrode supports are electrically isolated from the support strap, the bulb spacers and the reflector. The shroud is secured between the support strap and one of the electrode supports. The domed end of the shroud is preferably located at the lens end of the arc tube, but can also be located at the base end of the arc tube.

32 Claims, 2 Drawing Sheets

METAL HALIDE LAMP ASSEMBLY

FIELD OF THE INVENTION

This invention relates to electric lamps for general illumination and, more particularly, to electric lamps utilizing a metal halide arc tube mounted in a sealed reflector.

BACKGROUND OF THE INVENTION

Lamp assemblies incorporating reflectors are well known. Examples include spotlights and floodlights for indoor and outdoor use. Typically, a lamp is mounted in a sealed outer envelope. The outer envelope includes a reflecting interior surface, typically parabolic, for directing light in a preferred direction. The reflector is covered with a lens, and a base is provided for mounting the lamp assembly and for interconnection of the lamp to a source of electrical energy. Incandescent lamps, high pressure sodium lamps and mercury lamps have been utilized in such lamps assemblies.

Recently, it has been proposed to utilize metal halide arc discharge lamps in reflector-type lamp assemblies. Metal halide lamps provide excellent color, long life and high efficiency. Low wattage metal halide arc lamps include a generally cylindrical arc tube enclosing a suitable fill material such as sodium, scandium and mercury iodides. Electrodes are sealed in opposite ends of the arc tube, and electrode leads extend through press seals for connection to an electrical source.

In a lamp wherein a metal halide lamp is mounted in a reflector, several requirements must be met. It is preferred, in order to maximize light output, that the axis of the arc tube be aligned with the optical axis of the reflector and that the center of light output from the arc tube coincide with the focal point of the reflector. In mounting the metal halide lamp in the reflector, it is not feasible to attach a lamp support to the lens. Therefore, the arc lamp must be supported entirely from the base end.

It is well known that conductors located in proximity to an arc discharge tube containing sodium cause sodium migration or sodium electrolysis. Sodium ions migrate through the wall of the arc discharge tube and thereby reduce the life of the lamp. It is therefore desirable to keep conducting frame members and power leads away from the arc tube to the extent possible. In prior lamp assemblies, a "frameless" construction has been utilized in which a fine wire connects the electrode at the dome end of the arc tube to the electrical feedthrough at the base end of the lamp. The arc tube is supported by bulb spacers positioned at the base and dome ends of the bulb. The electrically isolated floating frame develops a positive charge which opposes the migration of sodium ions through the arc tube. As noted above, the double-ended mechanical mount is not feasible in a reflector-type assembly.

It has been found desirable to operate metal halide arc discharge lamps in a light transmissive quartz shroud or shield. The shroud substantially surrounds the arc tube and produces a higher and more uniform arc tube temperature than would otherwise occur. The shroud is in part responsible for the excellent color temperature and long operating life of the metal halide arc lamp. In addition, it is known that metal halide arc tubes are subject to burst on rare occasions. The shroud functions to contain shards of the arc tube when a burst occurs. The mounting arrangement for the arc tube must provide means for mounting both the shroud and the arc tube.

It is a general object of the present invention to provide improved reflector lamp assemblies.

It is another object of the present invention to provide reflector lamp assemblies which utilize metal halide arc discharge lamps.

It is a further object of the present invention to provide a metal halide reflector lamp assembly having long operating life.

It is a further object of the present invention to provide a lamp assembly, including a metal halide lamp surrounded by a light-transmissive shroud, suitable for mounting in a reflector.

It is yet another object of the present invention to provide a metal halide lamp assembly wherein all conductive parts except the electrical inleads are electrically isolated.

It is a further object of the present invention to provide a lamp assembly including a metal halide arc lamp mounted in a reflector, that is easily manufactured and low in cost.

SUMMARY OF THE INVENTION

According to the present invention, these and other objects and advantages are achieved in an electric lamp comprising a lamp envelope including a base for connection to an electrical source, an arc tube having an upper electrode lead and a lower electrode lead extending from opposite ends thereof, an arc tube support strap attached to one end of the arc tube, bulb spacer means coupled to the support strap for positioning the arc tube relative to the lamp envelope, a light-transmissive shroud substantially surrounding the arc tube and abutting against the support strap, an upper electrode support coupled to the upper electrode lead of the arc tube and extending outside the shroud to the base, and a lower electrode support coupled to the lower electrode lead of the arc tube and extending to the base. The upper and lower electrode supports couple electrical energy to the arc tube and are electrically isolated from the remainder of the lamp assembly.

The shroud typically includes a cylindrical portion coaxial with the arc tube. A first end of the cylindrical portion abuts against the support strap, and a domed portion encloses a second end of the cylindrical portion. In a preferred embodiment, the domed shroud is oriented with its open end at the base end of the arc tube and the domed end at the lens end of the arc tube. The upper electrode support is attached to the upper electrode lead just outside an opening in the domed portion and extends laterally from the upper electrode lead so that the shroud is secured between the support strap and the upper electrode lead.

The arc tube typically includes a flattened, press seal region on at least one end, and the support strap includes a pair of generally S-shaped strips positioned on opposite sides of the press seal region and secured together. The S-shaped strips form laterally-extending legs which support the shroud. The bulb spacer means preferably comprises a pair of arcuate spring elements coupled to opposite ends of the support strap legs and positioned to bear against an interior surface of the lamp envelope. The bulb spacer elements are preferably connected to the support strap by interconnecting rods.

In a preferred embodiment, the lamp envelope includes a reflecting interior surface for redirecting light from the arc tube, and a lens enclosing one end of the lamp envelope. The arc tube is typically a metal halide arc discharge tube. The lamp assembly aligns the longitudinal axis of the arc tube with the optical axis of the reflecting interior surface. The electrode supports comprise elongated rigid rods that are attached to the base for mechanical support of the arc tube and shroud, and for coupling of electrical energy to the arc tube. The electrode supports are electrically isolated from the support strap, the bulb spacers and the reflecting surface.

In an alternate embodiment, the domed portion of the shroud is located at the base end of the arc tube and the arc tube support strap is attached to the lens end of the arc tube. Support rods extend from the support strap to bulb spacers located near the base end of the arc tube.

BRIEF DESCRIPTION OF THE DRAWINGS

For a better understanding of the present invention together with other and further objects, advantages and capabilities thereof, reference is made to the accompanying drawings in which are incorporated herein by reference and which.

DETAILED DESCRIPTION OF THE INVENTION

Figure 1:
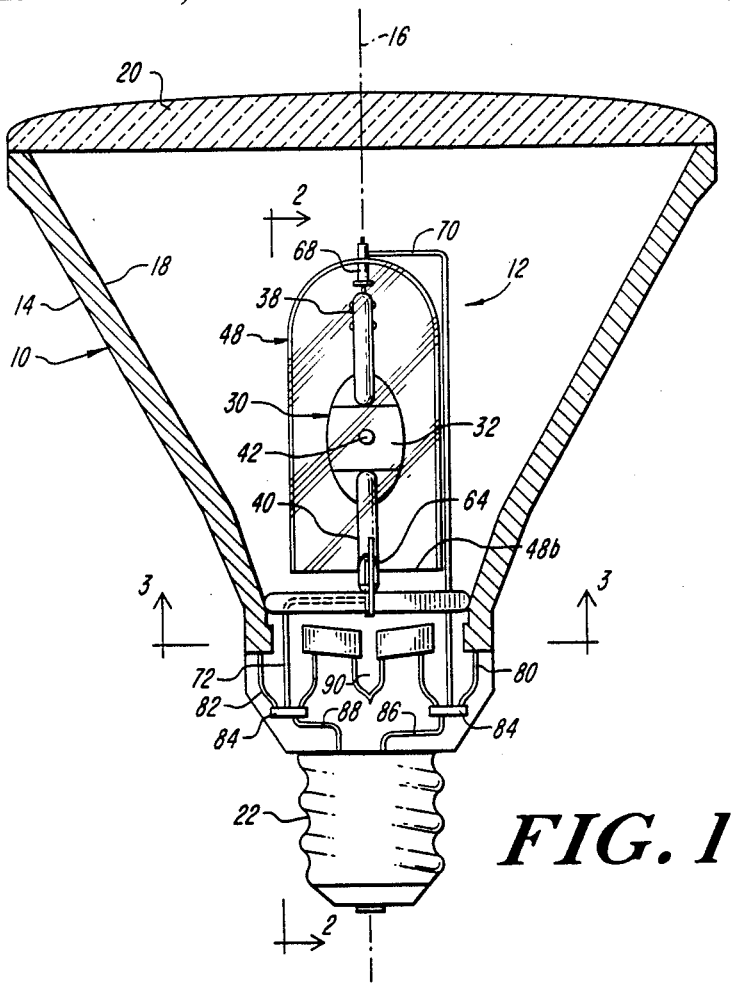
FIG. 1 is an elevational view, partly in cross section, of an electric lamp in accordance with the present invention.
Figure 2:
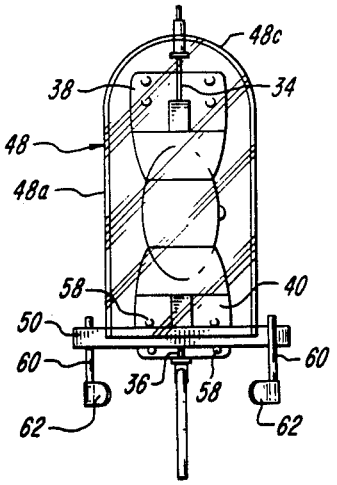
FIG. 2 is a cross-sectional view of the lamp assembly taken along the line 2—2 of FIG. 1.
Figure 3:
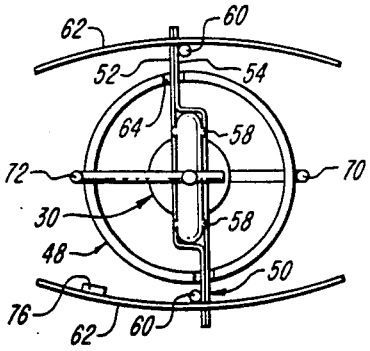
FIG. 3 is a cross-sectional view of the lamp assembly taken along the line 3—3 of FIG. 1.

An electrical lamp in accordance with the present invention is shown in FIG. 1. Detailed views of the lamp assembly are shown in FIGS. 2 and 3. A lamp envelope 10 forms a sealed enclosure for a lamp assembly 12. The lamp envelope 10 includes a reflector 14 having circular symmetry about an optical axis 16. A reflecting surface 18 on the interior surface of reflector 14 typically has a parabolic shape. Reflector 14 is closed by a lens 20. A base 22 provides a means for supplying electrical energy to the lamp assembly 12 and for mounting of the electric lamp. Typically the lamp envelope 10 is filled with nitrogen at a pressure of approximately 400 torr. An electric lamp of the type shown in FIG. 1 is typically utilized as a downlight, a spotlight or a floodlight for indoor or outdoor illumination.

The lamp assembly 12 includes an arc tube 30. The arc tube 30 is typically a low-wattage, metal halide lamp such as a type M100 manufactured and sold by GTE Products Corporation. Arc tube 30 encloses a discharge region 32 containing a fill material such as sodium, scandium and mercury iodides, and argon at a pressure of 100 torr. Electrodes (not shown) are sealed in opposite ends of the arc tube 30 and are coupled by electrode leads 34 and 36 through press seals 38 and 40, respectively, to the exterior of arc tube 30.

The arc tube 30 is mounted in lamp envelope 10 with its longitudinal axis on the optical axis 16 of reflector 14. Preferably, a light center 42 of arc tube 30 is positioned at the focal point of reflecting surface 18 for maximum light output in the desired direction.

A light-transmissive shield or shroud 48, substantially surrounds the arc tube 30. The shroud 48 is typically fabricated of quartz and includes a right circular cylindrical portion **48*a*, an open lower end 48*b* and a domed upper end 48*c*. The domed end 48*c* includes an opening for passage of electrode lead 34. The shroud 48 provides a higher and more uniform temperature during operation of arc tube 30 than would otherwise occur without the shroud. The shroud 48 is in part responsible for the excellent color temperature and the long operating life of metal halide arc tube. In addition, the shroud 48 provides a containment function in the rare event of an arc tube burst. The shroud 48 absorbs energy from shards of the arc tube 30. Although the shroud 48 may be shattered by a burst, the energy of the burst is partially absorbed so that the shards are completely contained within the lamp envelope 10. Shroud 48** preferably has a thickness of approximately two millimeters.

The mounting of the arc tube 30 and the shroud 48 will now be described with reference to FIGS. 1–3. As discussed hereinabove, it is preferable to minimize conducting surfaces in proximity to arc tube 30 in order to minimize sodium migration. Preferably, all metal parts are electrically floating, except for the leads which carry electrical energy to the arc tube 30.

A support strap 50 is attached to lower press seal 40 as best shown in FIGS. 2 and 3. The support strap 50 includes a first, generally S-shaped strip 52 and a second, generally S-shaped strip 54 located on opposite sides of press seal 40. To insure a snug fit on press seal 40, the strips 52 and 54 are placed on opposite sides of the arc tube 30 and are moved toward each other until they abut against the sides of press seal 40. Then, the strips 52 and 54 are spot welded together. The press seal 40 is preferably provided with projections 58 above and below support strap 50 to insure that the support strap 50 is correctly and permanently positioned on arc tube 30.

The support strap 50 includes legs that extend transversely from the axis of arc tube 30. Axially oriented connecting rods 60 are welded to each end of support strap 50. In a preferred embodiment, connecting rods 60 extend upwardly a short distance outside shroud 48 and limit lateral movement of shroud 48 along support strap 50. Arcuate bulb spacers 62 are welded to connecting rods 60. The bulb spacers 62 are typically spring steel and have a curvature which will fit the inside curvature of lamp envelope 10 in the base region. The shroud 48 abuts against the legs of support strap 50. Preferably, the shroud 48 includes notches 64 in the open lower end **48*b* for engaging support strap 50**.

Eyelets 68 are threaded onto electrode leads 34 and 36. The eyelets 68 are typically fabricated from nickel or nickel/silver and assist in making weld connections to the electrode leads 34 and 36. The upper electrode lead 34 and eyelet 68 extend through an opening in the domed upper end **48*c* of shroud 48 and are welded to an upper electrode support 70. Upper electrode support 70 extends transversely from lead 34 and then extends downwardly outside shroud 48 to the base region of the lamp. Similarly, a lower electrode support 72 is welded to electrode lead 36 and eyelet 68. Lower electrode support 72 extends transversely from the arc tube axis and then downwardly to the base region of the lamp. The downwardly extending portions of the electrode supports 70 and 72 preferably run on opposite sides of the lamp assembly and are angularly spaced from support strap 50 by approximately 90°. This configuration insures electrical isolation between electrode supports 70 and 72, and support strap 50. In a preferred embodiment, the electrode supports 70 and 72 are fabricated of 0.050-inch diameter, nickel plated steel rods. The electrode supports 70 and 72 carry electrical energy from an external source to arc tube 30. In addition, electrode supports 70 and 72 in conjunction with bulb spacers 62 mechanically support the lamp assembly 12 in the lamp envelope 10**.

With reference to FIG. 1, it is seen that the shroud 48 is secured between support strap 50 at the lower end and upper electrode support 70 at the upper end. The shroud 48 is restrained against lateral and rotational movement by notches 64 and is restrained against lateral movement by connecting rods 60.

The electrode supports 70 and 72 extend into metal cups 80 and 82, respectively, in the base region of the lamp. A brazing material 84 is used for electrical connection between the electrode supports and the metal cups. Wires 86 and 88, attached to the metal cups by spot welding or external brazing, interconnect metal cups 80 and 82, respectively, to the base 22 for connection to a power source. For a metal halide arc tube, an external ballast circuit (not shown) is utilized to provide the required current and voltage levels to arc tube 30. During assembly of the lamp, the brazing material 84 is placed in powder form in cups 80 and 82, and the cups are externally heated, causing a secure connection between each electrode support and the respective metal cup. Preferably, a copper/tin brazing material is utilized. It has been found that a copper/manganese/zinc brazing material is not suitable, since the brazing material and the associated flux fume when heated and can cause a conductive coating on the interior of the lamp. A tubulation 90 on lamp envelope 10 is utilized for evacuation, purging and back filling of the lamp envelope interior.

Figure 4:
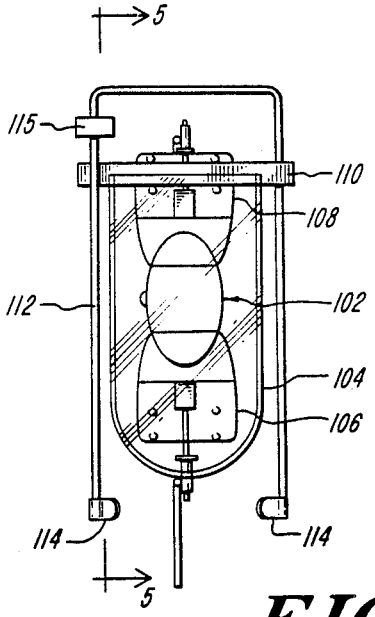
FIG. 4 is an elevational view of a lamp assembly in accordance with an alternate embodiment of the present invention.
Figure 5:
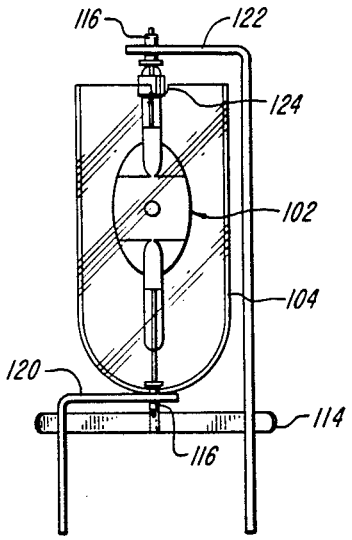
FIG. 5 is a cross-sectional view of the lamp assembly of FIG. 4 taken along the line 4—4.

An alternate embodiment of the lamp assembly is illustrated in FIGS. 4 and 5. An arc tube 102 of the same construction as arc tube 30 is mounted in a light transmissive shroud 104. The shroud 104 can have the same construction as shroud 48 shown in FIGS. 1–3. In the embodiment of FIGS. 4 and 5, the domed end of shroud 104 surrounds the base end 106 of arc tube 102, and the open end of shroud 104 is adjacent to the lens end 108 of arc tube 102. A support strap 110 is attached to the press seal region at the lens end of arc tube 102. The support strap 110 can be the same as support strap 50, shown and described hereinabove. A frame member 112 is formed of a rigid rod having the shape of an inverted U. The frame 112 is welded to opposite ends of support strap 110. The legs of frame member 112 extend downwardly outside shroud 104 to the region of base end 106. Bulb spacers 114 are welded to each end of frame member 112. A getter 116, such as a zirconium/aluminum, commercially available as ST101 sold by SAES Getters, Denver, Colorado, is preferably attached to frame member 112. A getter 76 of the same type is preferably used in the embodiment of FIGS. 1–3.

As best seen in FIG. 5, eyelets 116 are threaded onto the electrode leads of arc tube 102. The lower electrode lead, and eyelet 116 extends through an opening in the domed portion of shroud 104. A lower electrode support 120 is welded to the lower electrode lead and eyelet 116. The lower electrode support 120 extends transversely from the arc tube axis and then downwardly for attachment to the base. An upper electrode support 122 is welded to the upper electrode lead and eyelet 116. The upper electrode support 122 extends transversely from the arc tube axis and then downwardly outside shroud 104 to the base. The electrode supports 120 and 122 are formed of rigid rods and provide mechanical support for the lamp assembly. In addition, the electrode supports 120 and 122 carry electrical energy to the arc tube 102. The shroud 104 is secured between support strap 110 and lower electrode support 120. The shroud 104 is preferably provided with notches 124 which engage support strap 110 and prevent lateral and rotational movement of the shroud 104. The support strap 110, frame 112 and bulb spacers 144 are electrically isolated from electrode supports 120 and 122. Preferably, support strap 110 is oriented at about 90° relative to electrode supports 120 and 122 for maximum electrical isolation.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp comprising:

a lamp envelope having a base region including a base for connection to an electrical source;

an arc tube having an upper electrode lead and a lower electrode lead extending from opposite ends thereof;

an arc tube support strap attached to one end of said arc tube;

bulb spacer means coupled to said support strap for positioning said arc tube relative to said lamp envelope;

a light-transmissive shroud substantially surrounding said arc tube and abutting against said support strap;

an upper electrode support coupled to the upper electrode lead of said arc tube and extending outside said shroud to said base; and a lower electrode support coupled to the lower electrode lead of said arc tube and extending to said base, said upper and lower electrode supports providing mechanical support of said arc tube in said lamp envelope, coupling electrical energy to said arc tube and being electrically isolated from the remainder of said lamp, said arc tube and said shroud being mechanically supported in said lamp envelope entirely from the base region of said lamp envelope.

2. An electric lamp as defined in claim 1 wherein said support strap includes legs extending laterally in opposite directions from the axis of said arc tube.

3. An electric lamp as defined in claim 2 wherein said shroud includes a cylindrical portion coaxial with said arc tube and wherein a first end of said cylindrical portion abuts against the legs of said support strap.

4. An electric lamp as defined in claim 3 wherein said first end of said cylindrical portion includes notches for engaging the legs of said support strap.

5. An electric lamp as defined in claim 4 wherein said shroud includes a dome portion that encloses a second end of said cylindrical portion, said dome portion having an opening for one of said electrode leads.

6. An electric lamp as defined in claim 5 wherein said lamp envelope and said arc tube have a common longitudinal axis, said support strap is attached to the base end of said arc tube, and the dome portion of said shroud surrounds the end of said arc tube opposite said base.

7. An electric lamp as defined in claim 6 wherein said upper electrode support is attached to said upper electrode lead just outside the opening in said dome portion and extends laterally from said upper electrode lead so that said shroud is secured between said support strap and said upper electrode lead.

8. An electric lamp as defined in claim 2 wherein said arc tube includes a flattened press seal region at its end and wherein said support strap includes a pair of generally S-shaped strips positioned on opposite sides of the press seal region and secured together.

9. An electric lamp as defined in claim 8 wherein said press seal region includes outward projections for locating said support strap thereon.

10. An electric lamp as defined in claim 9 wherein said upper electrode support and said lower electrode support are angularly displaced about said longitudinal axis from said support strap.

11. An electric lamp as defined in claim 2 wherein said bulb spacer means comprises a pair of arcuate spring steel bulb spacer elements coupled to opposite ends of said support strap and located to bear against an interior surface of said lamp envelope.

12. An electric lamp as defined in claim 11 wherein said bulb spacer elements are connected to said support strap by interconnecting rods.

13. An electric lamp as defined in claim 1 wherein said lamp envelope includes a reflecting interior surface for redirecting light from said arc tube and a lens enclosing one end thereof.

14. An electric lamp as defined in claim 1 wherein said arc tube comprises a metal halide arc discharge tube.

15. An electric lamp as defined in claim 1 wherein each of said electrode supports comprises an elongated rigid rod.

16. An electric lamp as defined in claim 5 wherein said lamp envelope and said arc tube have a common longitudinal axis, said support strap is attached to the end of said arc tube opposite the base and the dome portion of said shroud surrounds the base end of said arc tube.

17. An electric lamp as defined in claim 16 wherein said lower electrodes support is attached to said lower electrode lead just outside the opening in said dome portion and extends laterally from said lower electrode lead so that said shroud is secured between said support strap and said lower electrode lead.

18. An electric lamp comprising:

a lamp envelope including a reflecting surface having an optical axis, a lens and a base region, said base region including a base for connection to an electrical source;

an arc tube having a longitudinal axis aligned with said optical axis, said arc tube including an upper electrode lead extending from a lens end and a lower electrode lead extending from a base end;

an arc tube support strap attached to the base end of said arc tube and including legs extending laterally in opposite directions from the axis of said arc tube;

bulb spacer means coupled to the legs of said support strap for positioning said arc tube relative to said lamp envelope;

a light-transmissive shroud around said arc tube, said shroud including an open end which abuts against the legs of said support strap and a domed end which substantially encloses the lens end of said arc tube;

an upper electrode support coupled to the upper electrode lead of said arc tube and extending outside said shroud to said base; and a lower electrode support coupled to the lower electrode lead of said arc tube and extending to said base, said upper and lower electrode supports providing mechanical support of said arc tube in said lamp envelope and being electrically isolated from said support strap, said bulb spacer means and said reflector, said arc tube and said shroud being mechanically supported in said lamp envelope entirely from the base region of said lamp envelope.

19. An electric lamp as defined in claim 18 wherein the open end of said shroud includes notches for engaging the legs of said support strap.

20. An electric lamp as defined in claim 18 wherein said arc tube includes a flattened press seal region at its lower end and wherein said support strap includes a pair of generally S-shaped strips positioned on opposite sides of the press seal region and secured together.

21. An electric lamp as defined in claim 20 wherein said press seal region includes outward projections for locating said support strap thereon.

22. An electric lamp as defined in claim 21 wherein said upper electrode support and said lower electrode support are angularly displaced about said longitudinal axis from said support strap.

23. An electric lamp as defined in claim 18 wherein said bulb spacer means comprises a pair of arcuate spring steel bulb spacer elements coupled to opposite ends of said support strap and located to bear against an interior surface of said lamp envelope.

24. An electric lamp as defined in claim 23 wherein said bulb spacer elements are connected to said support strap by interconnecting rods.

25. An electric lamp as defined in claim 18 wherein said arc tube comprises a metal halide arc discharge tube.

26. A lamp assembly for an electric lamp including a lamp envelope having a reflecting surface, a lens and a base region, said base region including a base for connection to an electrical source, said lamp assembly comprising:

an arc tube including an upper electrode lead extending from a lens end thereof and a lower electrode lead extending from a base end thereof;

an arc tube support strap attached to a base end of said arc tube an including legs extending laterally in opposite directions from the axis of said arc tube;

bulb spacer means coupled to the legs of said support strap for positioning said arc tube in said lamp envelope;

a light-transmissive shroud around said arc tube, said shroud including an open end which abuts against the legs of said support strap and a domed end which substantially encloses the lens end of said arc tube;

an upper electrode support coupled to the upper electrode lead of said arc tube and extending outside said shroud for interconnection to the base of said lamp envelope adjacent to the base end of said arc tube; and a lower electrode support coupled to the lower electrode lead of said arc tube for interconnection to the base of said lamp envelope, said upper and lower electrode supports providing mechanical support of said arc tube in said lamp envelope and being electrically isolated from said support strap and said bulb spacer means, said arc tube and said shroud being mechanically supported in said lamp envelope entirely from the base region of said lamp envelope.

27. A lamp assembly as defined in claim 26 wherein the open end of said shroud includes notches for engaging the legs of said support strap.

28. A lamp assembly as defined in claim 26 wherein said arc tube includes a flattened press seal region at its lower end and wherein said support strap includes a pair of generally S-shaped strips positioned on opposite sides of the press seal region and secured together.

29. A lamp assembly as defined in claim 28 wherein said press seal region includes outward projections for locating said support strap thereon.

30. A lamp assembly as defined in claim 29 wherein said upper electrode support and said lower electrode support are angularly displaced about said longitudinal axis from said support strap.

31. A lamp assembly as defined in claim 26 wherein said bulb spacer means comprises a pair of arcuate spring steel bulb spacer elements coupled to opposite ends of said support strap and located to bear against an interior surface of said lamp envelope.

32. A lamp assembly as defined in claim 26 wherein said arc tube comprises a metal halide arc discharge tube.

* * * * *